US006447070B1

(12) United States Patent
Ekman et al.

(10) Patent No.: US 6,447,070 B1
(45) Date of Patent: Sep. 10, 2002

(54) PNEUMATIC, BALL-SHAPED CHAIR

(76) Inventors: June Ekman, 47 W. 28th St., New York, NY (US) 10001; Laurence A. Wilson, R.R. 1, Box 55, Uniondale, PA (US) 18470

( * ) Notice: Subject to any disclaimer, the term of this patent is extended or adjusted under 35 U.S.C. 154(b) by 0 days.

(21) Appl. No.: 09/802,727

(22) Filed: Mar. 12, 2001

(51) Int. Cl.[7] ..... A47C 7/02; A61H 1/00

(52) U.S. Cl. ..... 297/452.41; 297/344.12; 297/344.18; 605/45

(58) Field of Search ..... 297/452.41, 445.1, 297/452.56, 217.1, DIG. 3, 344.12; 601/45

(56) References Cited

U.S. PATENT DOCUMENTS 5,494,333 A * 2/1996 Wilson ..... 297/344.18
5,601,528 A * 2/1997 Mancarella ..... 601/45
5,690,389 A 11/1997 Ekman et al. ..... 297/452.41
6,070,943 A * 6/2000 Guery-Strahm ..... 297/452.41
6,095,607 A * 8/2000 Wenzel ..... 297/344.18

FOREIGN PATENT DOCUMENTS

DE 9306731 U 1 * 10/1993
DE 297 02 389 U 1 * 6/1997
DE 94 21 950 U 1 * 8/1997
DE 200 10 364 U1 * 11/2000
SE 679444 A5 * 2/1992

* cited by examiner

*Primary Examiner*—Rodney B. White
(74) *Attorney, Agent, or Firm*—Salzman & Levy

(57) ABSTRACT

A chair or stool having a substantially spherical seat component. The spherical seat component is supported upon identical base support units that are designed to stack or nest within each other. Addition or subtraction of the base support units raises and lowers the chair or stool, so that the chair or stool can comfortably fit most people of different size or height. A novel mounting mechanism firmly attaches the spherical seat to the base support unit or units.

13 Claims, 4 Drawing Sheets

PNEUMATIC, BALL-SHAPED CHAIR

FIELD OF THE INVENTION

The present invention pertains to pneumatic ball-shaped chairs and, more particularly, to a ball-shaped chair or stool having a new base adjustment for adapting the chair or stool to fit people of different sizes and heights and to a new method used to attach the pneumatic ball to the chair or stool.

BACKGROUND OF THE INVENTION

There are myriad chair designs extant, many of which claim to be more efficient, more comfortable, or more therapeutic than their competition. Many chairs in the marketplace have the ability to stack one within the other, thus providing a more efficient means for storing these chairs, when not in use.

Recently, a new type of ball-shaped chair has been developed that is comfortable to individuals with special needs: individuals who work long hours at a desk, or who have back problems (e.g., herniated disks, scoliosis, etc.). People who sit upon the inflated, spherical shell, or the pneumatic ball of this chair are able to sit in comfort over an extended period of time. The inflatable, curved surface allows the anomalies of the spine to adjust and align with the "floating", spherical support, thus providing sustained comfort and/or therapy. Such a ball-shaped chair is illustrated in U.S. Pat. No. 5,690,389 issued to June Ekman and Laurence A. Wilson on Nov. 25, 1997, for PNEUMATIC, BALL-SHAPED CHAIR.

The aforementioned ball-shaped chair, which has met with great acceptance in the marketplace, was primarily designed for adults. As such, the chair had a range of adjustment befitting only adult individuals.

Many young people, particularly teenagers and youngsters, have enjoyed sitting in the ball-shaped chair. Some of these young people mentioned that they would like to have a ball-shaped chair designed for their use. The chair designed for an adult did not scale down well to accommodate these young people. The height adjustment system had to be simpler and less expensive and the ball-shaped pneumatic seat had to be firmly attached to the base.

The present invention reflects the discovery that the ball-shaped chair could be used comfortably by persons of different sizes and heights by redesigning the base portion. The new base has been structured as a stacking component. Each base component nests within a similar base unit. A chair so fitted can be raised and lowered by the new, stacking bases. Use of the new base allows for a single chair size, one that comfortably fits all.

In addition, the ball-shaped component of the chair can be used in stools, whose identical base units can also be stacked to provide a height adjustment. A clamping method has been developed to keep the ball on the stool.

SUMMARY OF THE INVENTION

In accordance with the present invention, there is provided a ball-shaped chair or stool, comprising a base portion that is stackable. Each base component nests within an identical base component. Nesting the base components allows for adjustment of the height of the chair or stool, such that the chair can be easily raised or lowered. Most people of different heights and sizes can fit comfortably on the same ball-shaped chair or stool by adding or removing a base component from the stack of nesting base units. Thus, if a ball-shaped chair is purchased for a youngster, that youngster can use that chair into adulthood. The same chair will comfortably fit almost any person, throughout his lifetime.

It is an object of this invention to provide an improved ball-shaped chair or stool.

It is another object of the invention to provide a ball-shaped chair or stool having stackable base units, whereby the chair can be raised or lowered easily to accommodate people of It is another object of the invention to provide a clamping mechanism to secure the ball-shaped pneumatic seat to the chair or stool.

BRIEF DESCRIPTION OF THE DRAWINGS

A complete understanding of the present invention may be obtained by reference to the accompanying drawings, when taken in conjunction with the subsequent, detailed description thereof, in which.

For purposes of clarity and brevity, like components and elements will bear the same numbers and designations throughout the FIGS.

DESCRIPTION OF THE PREFERRED EMBODIMENT

Generally speaking, the invention features a chair or stool comprising a spherical seat component. The spherical seat component is supported upon identical base units that are designed to stack or nest within each other. Addition or subtraction of the base units raises and lowers the height of the chair or stool, such that the chair or stool can comfortably fit most people of different size or height.

Figure 1:
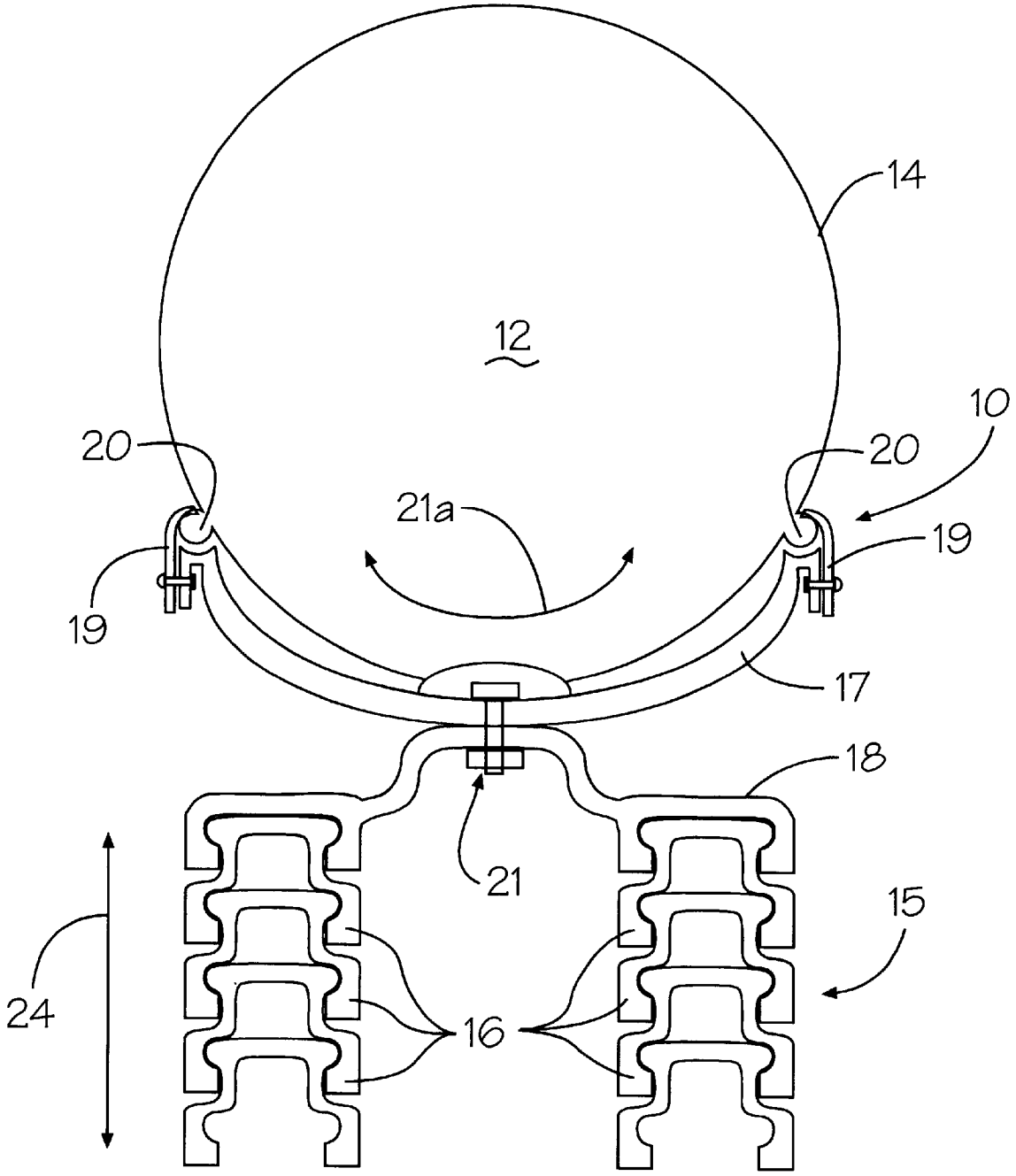
FIG. 1 illustrates a front cross-sectional view of a ball-shaped chair in accordance with this invention, the chair having a plurality of stacking base units, wherein the height of the chair can be easily raised or lowered to accommodate the height of an individual.

Now referring to FIG. 1, the ball-shaped chair 10 of this invention is depicted. The chair 10 comprises a substantially spherical seat 12 that consists of an inflatable skin or shell 14. The skin or shell 14 is air-impermeable, flexible and tough. The skin 14 allows for a person's spine to vertically adjust itself with respect to the support being provided to the ball-shaped chair 10 by its supporting frame 17. The supporting frame 17 is clamped to the spherical seat 12 by means of a clamp ring 19 that captures a continuous, preferably tubular ring 20 disposed inside the shell 14, as shown. Ring 20 is cut perpendicularly to its longitudinal axis to facilitate insertion thereof through the inflation hole 22 (FIG. 3) to the lower, inside portion of the shell 14. Once inserted, the ends of the ring 20 abut each other by means of alignment mechanisms, not shown, forming a substantially continuous ring 20. Alternative means for firmly attaching the frame 17 to seat 12 include adhesive means and hook and loop mechanisms, not shown.

The shell 14, supported upon the frame 17, bolts to a middle base support 18, via a bolt and nut 21. Such a single point mounting allows for swiveling of the seat 12 relative to the base support 18, as indicated by arrow 21*a*. The middle base support 18 can be made to rest upon the floor, in its own right. However, in order to increase or decrease the height of the chair 10, stackable base units 16 can be added or subtracted with respect to the middle base support 18 in order to form a lower base support 15, as shown. The identical, stackable base units 16 are nesting or stackable within each other, such that the height of the chair 10 can be raised or lowered easily, as illustrated by arrows 24. The base units 16, shown here in sectional view, can form a geometric base that is round, square, or oblong.

The skin 14 of the ball-shaped chair 10 may be fabricated from a flexible, air-impermeable plastic, such as polypropylene or vinyl, a rubber material, such as neoprene, or a leather material. As aforementioned, the inflatable, flexible skin 14 re-forms in response to the weight and seated position of a person, thus allowing the spine of a seated individual to properly adjust to the ball-shaped chair 10, as described in aforementioned U.S. Pat. No. 5,690,389, whose teachings are meant to be incorporated herein by way of reference.

The lowest unit 16 of the lower base support 15 may comprise rollers, castors, ball wheels, or other rolling supports (FIG. 4), as is well known in this art.

To provide added stability and support to a seated individual, right and left arms (as shown in the aforesaid patent) can be provided as handles to aid in moving the chair and to facilitate sitting.

Figure 2:
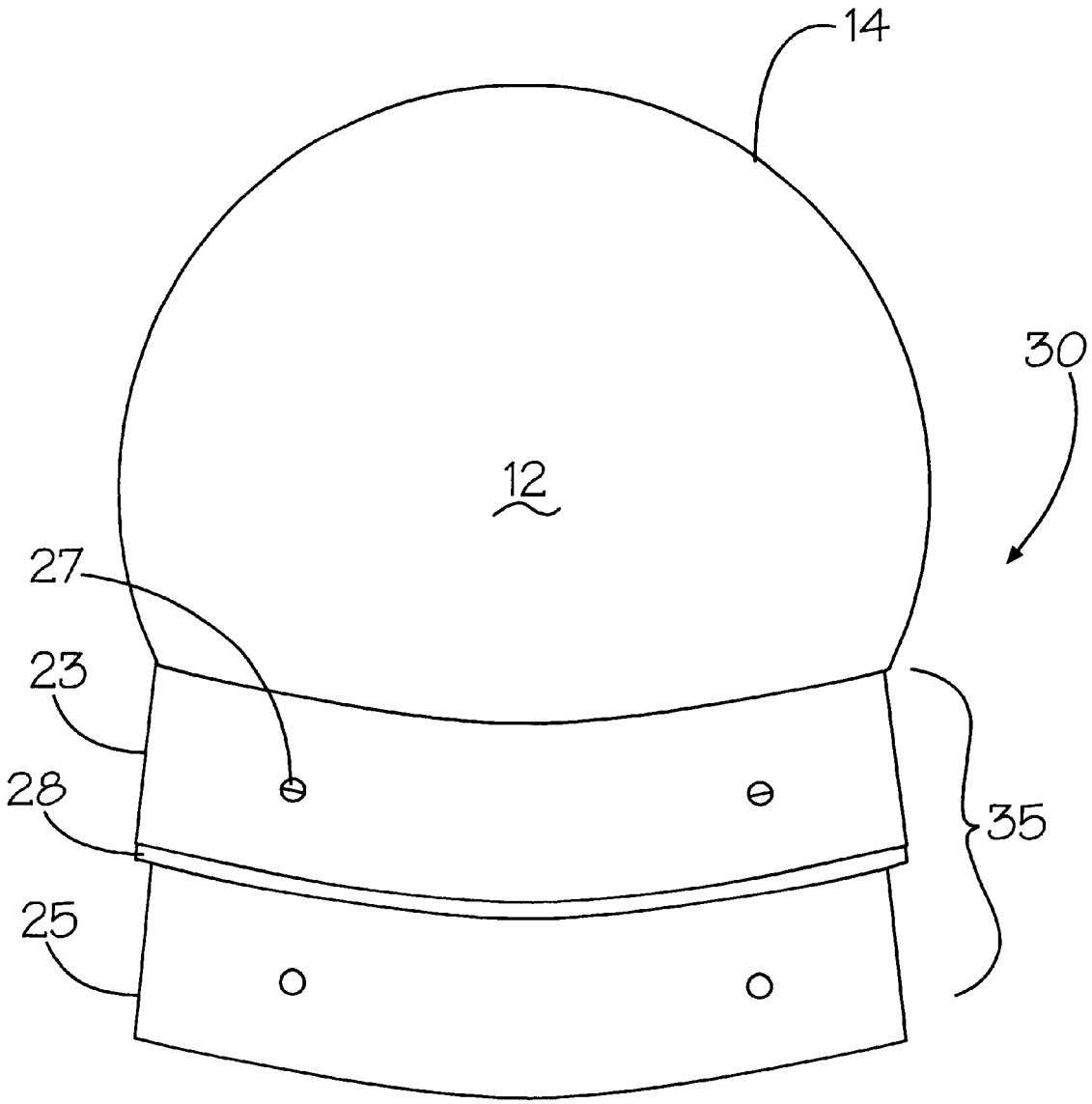
FIG. 2 depicts a front, perspective view of a ball-shaped stool.

Referring to FIG. 2, a ball-shaped stool 30 is shown. The ball-shaped stool 30 comprises a spherical seat 12 supported upon a truncated conical base unit 35. An inflation hole 22 (FIG. 3) is provided at the lowermost location of the seat 12. The base unit 35 comprises a tapered unit 25 and a clamping cylinder 23 held in place by fasteners 27 that capture the continuous ring 20 located on the inside of spherical shell 14 as illustrated in FIG. 3.

Figure 3:
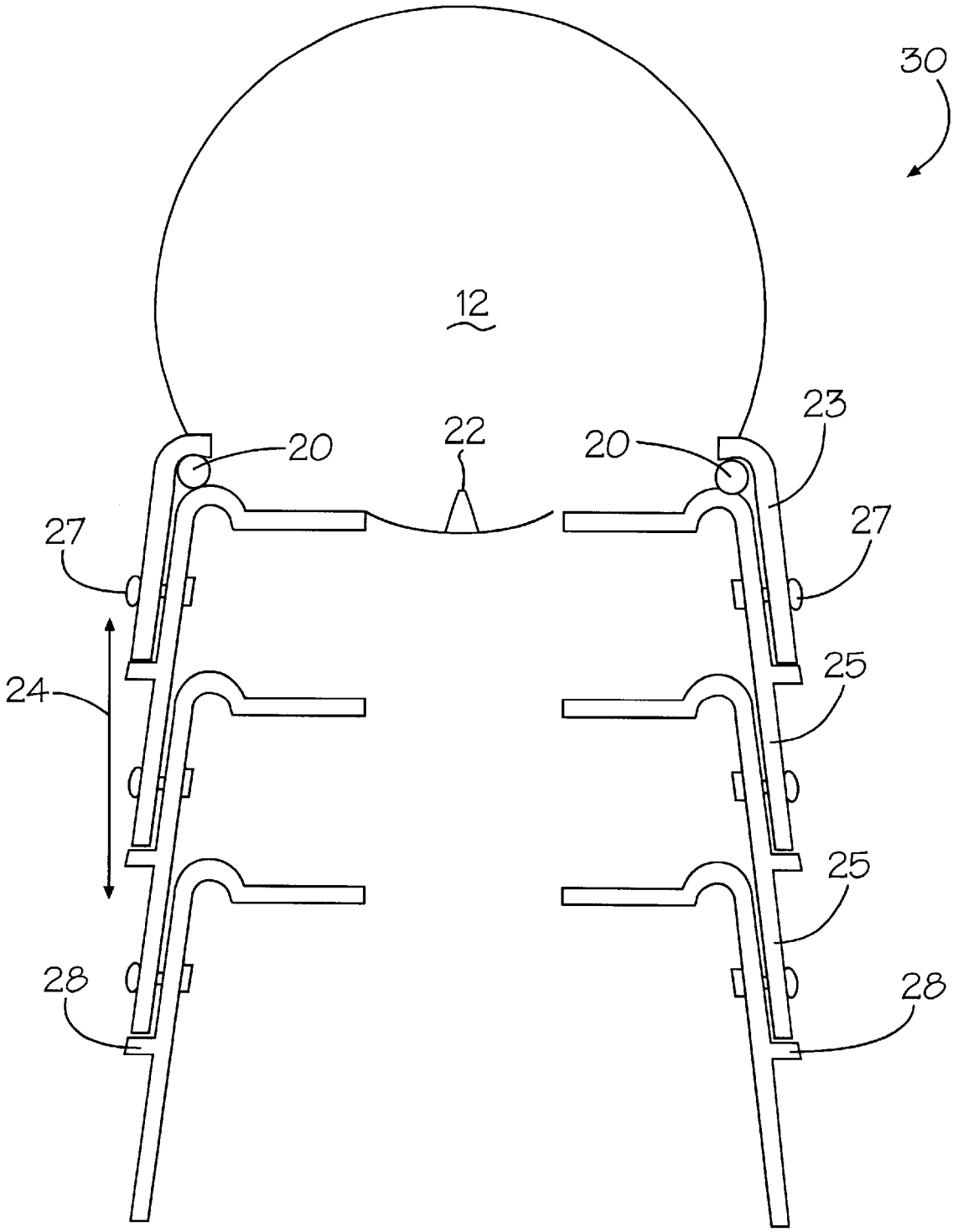
FIG. 3 shows a sectional view of the ball-shaped stool of FIG. 2, having a plurality of stacking base units, wherein the height of the stool can be raised or lowered easily to accommodate the height of an individual.

Referring now to FIG. 3, the base units 25 are stackable and nesting, and can be held in place with fasteners 27, preferably bolts and nuts or spring-loaded pins. Thus the stool 30 can be raised or lowered as shown by arrows 24. Molded stops 28 are provided on the outside surface of base units 25 in order to assure proper nesting thereof.

Figure 4:
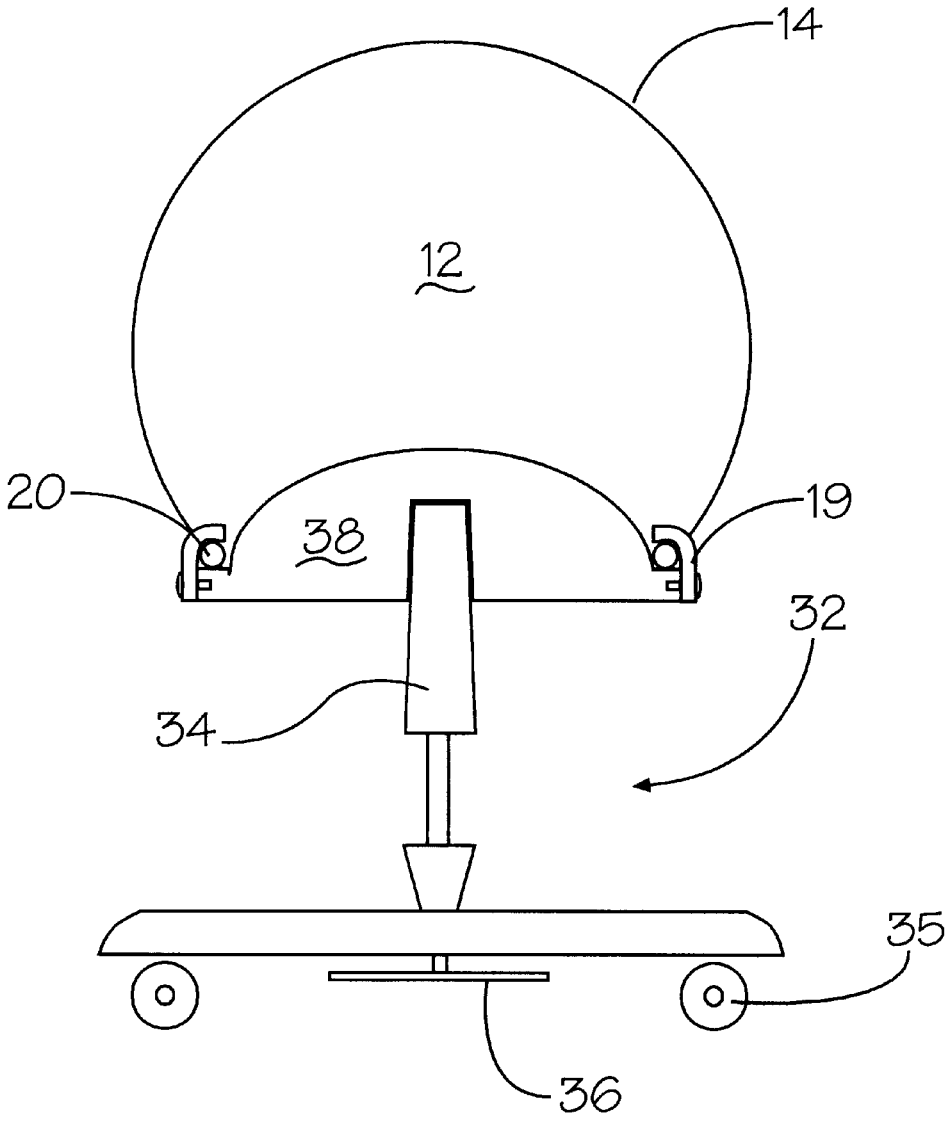
FIG. 4 is a sectional view of a ball-chair including a conventional lower chair structure, height adjustment mechanism and castors in accordance with the invention.

Referring now to FIG. 4, the ball seat 12 can also be adapted for mounting on a conventional lower chair structure 32 that can swivel and be mounted on castors 35. Moreover, a standard, gas-assisted vertical lift mechanism 34 can also be provided upside-down to lift the seat 12 of the stool 30 relative to such lower chair structure 34 with castors 35. The lift mechanism 34 is activated by a foot ring 36, manufactured by the EST Company of Grafton, Wisconsin.

Shell 14 conforms to the dome-like shape of the molded seat support 38 and is mounted to the lower chair structure 34 by means of ring 20 and clamping mechanism 19 in accordance with the invention. It should also be understood that the aforementioned height adjustment mechanism 34 is optional; a three-legged, fixed lower chair structure, for example (not shown) can be used with the present mounting system.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having described the invention, what is desired to be protected by letters patent is presented by the subsequently appended claims.

What is claimed is:

1. A ball-shaped chair or stool whose height can be adjusted by the addition or subtraction of nesting base units, comprising:

an inflatable, substantially spherical shell forming a substantially spherical seat;

a base support carrying said substantially spherical shell and including a number of nesting base units for raising and lowering the height of said ball-shaped chair or stool by the addition or subtraction of at least one of said nesting base units from said base support; and a substantially continuous ring disposed within said spherical shell, and means operatively connected to said base support for clamping said spherical seat thereto.

2. The ball-shaped chair or stool in accordance with claim 1, wherein said clamping means comprises a clamping collar.

3. The ball-shaped chair or stool in accordance with claim 1, further comprising mounting means connected to said spherical seat and to said base support for allowing said spherical seat to swivel relative to said base support.

4. A height adjustable ball-shaped chair or stool whose height can be adjusted by the addition or removal of supporting base units, comprising:

a substantially spherical seat;

a base support carrying said substantially spherical seat and including a number of removable and additive base units for decreasing and increasing the height of said ball-shaped chair or stool; and a substantially continuous ring disposed within said spherical seat, at a lower portion thereof.

5. The height adjustable ball-shaped chair or stool in accordance with claim 4, further comprising:

clamping means operatively connected to said base support for securing said ring and said seat to said base support.

6. The height adjustable ball-shaped chair or stool in accordance with claim 5, further comprising mounting means connected to said spherical seat and to said base support for allowing said spherical seat to swivel relative to said base support.

7. A ball-shaped chair or stool, comprising:

an inflatable, substantially spherical shell forming a substantially spherical seat and having a substantially continuous ring disposed therein; and a base support carrying said spherical shell and having clamping means for clamping and firmly attaching said spherical shell to said base support.

8. The ball-shaped chair or stool in accordance with claim 7, wherein said means to firmly attach said spherical shell to said base support comprises adhesive means.

9. The ball-shaped chair or stool in accordance with claim 7, wherein said means to firmly attach said spherical shell to said base support comprises hook and loop means.

10. The ball-shaped chair or stool in accordance with claim 7, wherein said clamping means comprises a clamping collar.

11. The ball-shaped chair or stool in accordance with claim 10, further comprising mounting means connected to said spherical seat and to said base support for allowing said spherical seat to swivel relative to said base support.

12. The ball-shaped chair or stool in accordance with claim 11, further comprising height adjustment means operatively connected to said spherical seat for raising said seat relative to said base support.

13. The ball-shaped chair or stool in accordance with claim 7, further comprising height adjustment means operatively connected to said spherical seat for raising said seat relative to said base support.

* * * * *